US010721978B2

(12) United States Patent
Li

(10) Patent No.: US 10,721,978 B2
(45) Date of Patent: Jul. 28, 2020

(54) WEARABLE AIRBAG

(71) Applicant: TOYOTA MOTOR ENGINEERING & MANUFACTURING NORTH AMERICA, INC., Erlanger, KY (US)

(72) Inventor: Yi Li, Ann Arbor, MI (US)

(73) Assignee: TOYOTA MOTOR ENGINEERING & MANUFACTURING NORTH AMERICA, INC., Erlanger, KY (US)

( * ) Notice: Subject to any disclaimer, the term of this patent is extended or adjusted under 35 U.S.C. 154(b) by 777 days.

(21) Appl. No.: 15/154,407

(22) Filed: May 13, 2016

(65) Prior Publication Data

US 2017/0325521 A1 Nov. 16, 2017

(51) Int. Cl.
*A41D 13/00* (2006.01)
*A41D 13/018* (2006.01)

(52) U.S. Cl.
CPC ..... *A41D 13/018* (2013.01); *Y10S 2/03* (2013.01)

(58) Field of Classification Search
CPC ..... A41D 13/018; Y10S 2/03
See application file for complete search history.

(56) References Cited

U.S. PATENT DOCUMENTS 5,781,936 A * 7/1998 Alaloof ..... A41D 13/018 2/456
6,032,299 A * 3/2000 Welsh ..... A41D 13/018 2/456
6,125,478 A * 10/2000 Alaloof ..... A41D 13/018 2/456
6,433,691 B1 * 8/2002 Hilliard ..... A41D 13/018 280/728.1
6,546,561 B2 4/2003 Duhamell
7,017,195 B2 * 3/2006 Buckman ..... A41D 13/018 2/455
7,401,364 B2 7/2008 Goto et al.
7,484,751 B2 * 2/2009 Goto ..... A41D 13/018 2/462
7,543,846 B2 * 6/2009 Makabe ..... A41D 13/018 280/730.1
7,721,357 B2 5/2010 Makabe et al.
7,849,519 B2 12/2010 Goto
8,365,316 B2 2/2013 Jan et al.
8,505,670 B2 * 8/2013 Ogawa ..... A41D 13/018 180/274
8,595,864 B2 12/2013 Orita et al.
(Continued)

FOREIGN PATENT DOCUMENTS

JP 2003-138407 A 5/2003
JP 2010-264965 A 11/2010

*Primary Examiner* — Richale L Quinn
(74) *Attorney, Agent, or Firm* — Oblon, McClelland, Maier & Neustadt, L.L.P.

(57) ABSTRACT

A system for providing wearable inflatable impact protection, the system having a wearable airbag garment, a first airbag chamber connected to the wearable airbag garment, an airbag igniter connected to the first airbag chamber, a controller connected to the airbag igniter, a sensor array connected to the controller, and a power source connected to the controller. The sensor array detects at least one of use, movement, location, and acceleration of the wearable airbag garment. The controller triggers the airbag igniter to inflate the first airbag chamber in a case where the controller determines at least one of a set of performance criteria has been exceeded.

12 Claims, 5 Drawing Sheets

(56) References Cited

U.S. PATENT DOCUMENTS

| | | | | |
|---|---|---|---|---|
| 8,662,528 | B1 * | 3/2014 | Abdulaziz | A41D 13/018 2/455 |
| 9,126,065 | B2 * | 9/2015 | Uchida | A41D 13/018 |
| 10,154,695 | B2 * | 12/2018 | Jin | A61B 5/1117 |
| 2005/0067816 | A1 * | 3/2005 | Buckman | A41D 13/018 280/730.1 |
| 2005/0230937 | A1 * | 10/2005 | Yatagai | B60R 21/23 280/728.1 |
| 2006/0125206 | A1 * | 6/2006 | Goto | A41D 13/018 280/290 |
| 2008/0178370 | A1 * | 7/2008 | Orita | A41D 13/018 2/455 |
| 2009/0127835 | A1 * | 5/2009 | Lin | A41D 13/018 280/730.1 |
| 2010/0148564 | A1 | 6/2010 | Carter | |
| 2012/0131718 | A1 * | 5/2012 | Uchida | A62B 99/00 2/69 |
| 2013/0276213 | A1 * | 10/2013 | Olsson | A42B 3/0486 2/413 |
| 2014/0277101 | A1 * | 9/2014 | Smith | A61B 17/1325 606/202 |
| 2016/0067123 | A1 * | 3/2016 | Arzanpour | A61G 5/10 701/46 |
| 2016/0183607 | A1 * | 6/2016 | Lopez Yunez | A41D 13/018 2/455 |
| 2016/0270472 | A1 * | 9/2016 | Allen | A41D 13/018 |
| 2017/0049164 | A1 * | 2/2017 | Gruentzig | A42B 3/046 |
| 2017/0181485 | A1 * | 6/2017 | Jin | A61B 5/1117 |
| 2017/0325521 | A1 * | 11/2017 | Li | A41D 13/018 |
| 2018/0027894 | A1 * | 2/2018 | Bangera | A41D 13/018 |

* cited by examiner

WEARABLE AIRBAG

BACKGROUND

Field of the Disclosure

The present disclosure is directed toward a wearable airbag system and method.

Description of the Related Art

With the proliferation of autonomous and semi-autonomous driving technologies, drivers will gradually have a reduced role in operating vehicles and more latitude to move about or change seating positions, and perhaps locations, as well. However, safety remains a significant concern and drivers and passengers alike should remain vigilant that existing safety precautions continue to be observed responsibly, and that new ones are introduced address evolving needs and requirements.

For these reasons it is important that improved methods and apparatus for detection and protection of vehicle occupants in a crash situation continue to be developed with the aim of reducing the frequency and severity of such incidents, on public roads and highways.

SUMMARY

The present disclosure is directed to a system for providing wearable inflatable impact protection, the system having a wearable airbag garment, a first airbag chamber connected to the wearable airbag garment, an airbag igniter connected to the first airbag chamber, a controller connected to the airbag igniter, a sensor array connected to the controller, and a power source connected to the controller. The sensor array detects at least one of use, movement, location, and acceleration of the wearable airbag garment. Use may, for example, include detection of fastening of a fastener of a wearable airbag. The controller triggers the airbag igniter to inflate the first airbag chamber in a case where the controller determines at least one of a set of performance criteria has been exceeded.

The foregoing general description of the illustrative implementations and the following detailed description thereof are merely exemplary aspects of the teachings of this disclosure, and are not restrictive.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings wherein.

DETAILED DESCRIPTION OF THE EMBODIMENTS

Figure 1:
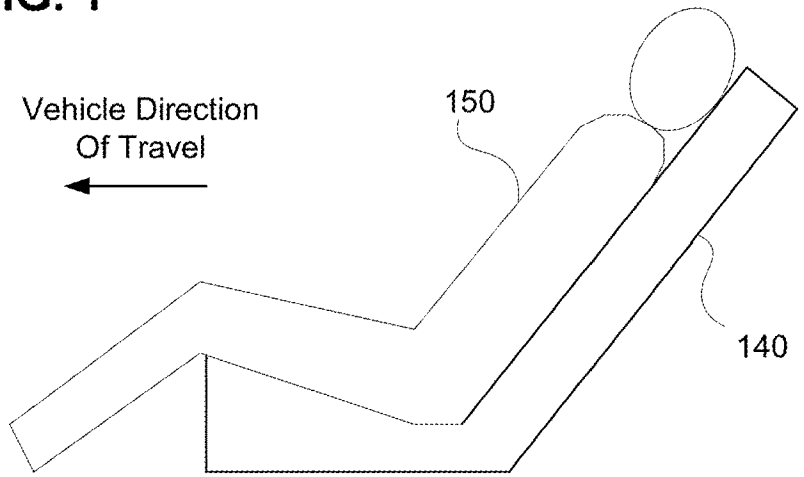
FIG. 1 is a diagram of an occupant seated in a reclined position, according to one example.

In the drawings, like reference numerals designate identical or corresponding parts throughout the several views. Further, as used herein, the words "a", "an" and the like generally carry a meaning of "one or more", unless stated otherwise.

Referring now to the drawings, wherein like reference numerals designate identical or corresponding parts throughout the several views.

Figure 2:
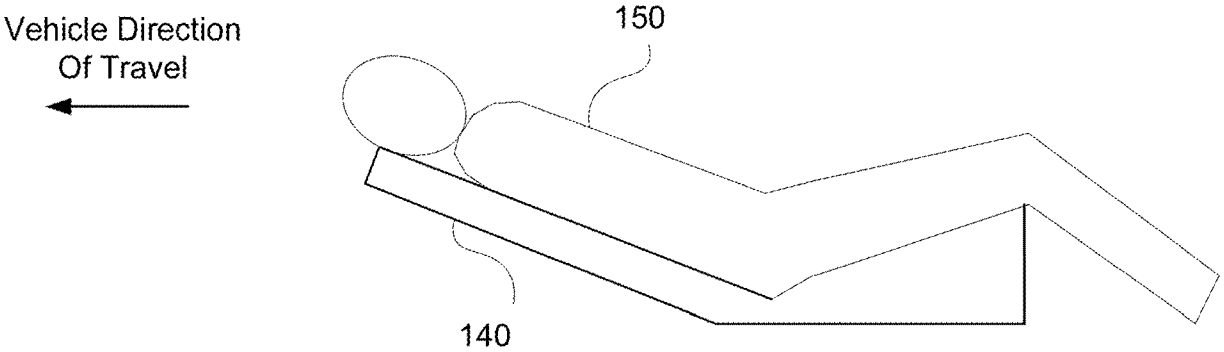
FIG. 2 is a diagram of an occupant seated in a reclined position, according to one example.
Figure 3:
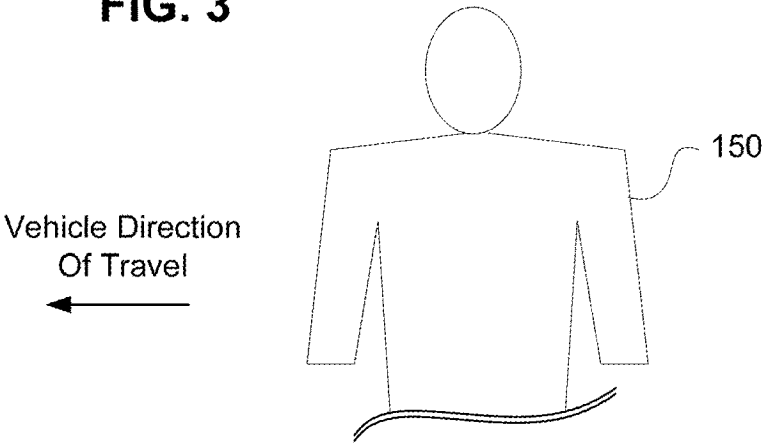
FIG. 3 is a diagram of an occupant positioned laterally to a vehicle direction of travel, according to one example.

FIG. 1 through FIG. 3 illustrate exemplary seating positions an occupant 150 may take, depending on whether the occupant 150 is driving a vehicle 200, or the vehicle 200 is operating in a semi-autonomous or autonomous driving mode. In cases where the vehicle 200 is operating in a semi-autonomous or autonomous driving mode, or where the occupant 150 is not the driver of the vehicle 200, the occupant 150 may be free to assume one of many possible positions, seated or otherwise. While generally preferable that the occupant 150 uses a primary restraint, for example a seatbelt, the use of a wearable airbag garment 100 such as a wearable airbag jacket 100*a*, a wearable airbag vest 100*b*, or a wearable airbag vest 100*c* is intended to provide the occupant 150 with additional protection in the event of a collision or accident.

FIG. 1 is a diagram of an occupant 150 seated in a reclined position, according to one example. The vehicle 200 is traveling in a direction as indicated. The occupant 150 is disposed upon a seat 140, the seat 140 in a reclined position.

FIG. 2 is a diagram of an occupant 150 seated in a reclined position, according to one example. The vehicle 200 is traveling in a direction as indicated. The occupant 150 is disposed upon a seat 140, the seat 140 in a reclined position opposite to that shown in FIG. 1 and at an angle that is closer to a horizontal plane.

FIG. 3 is a diagram of an occupant 150 positioned laterally to a vehicle direction of travel, according to one example. The vehicle 200 is traveling in a direction as indicated. The occupant 150 is seated upon a seat 140 (not shown) and facing a side substantially parallel to the direction of travel of the vehicle 200.

Figure 4:
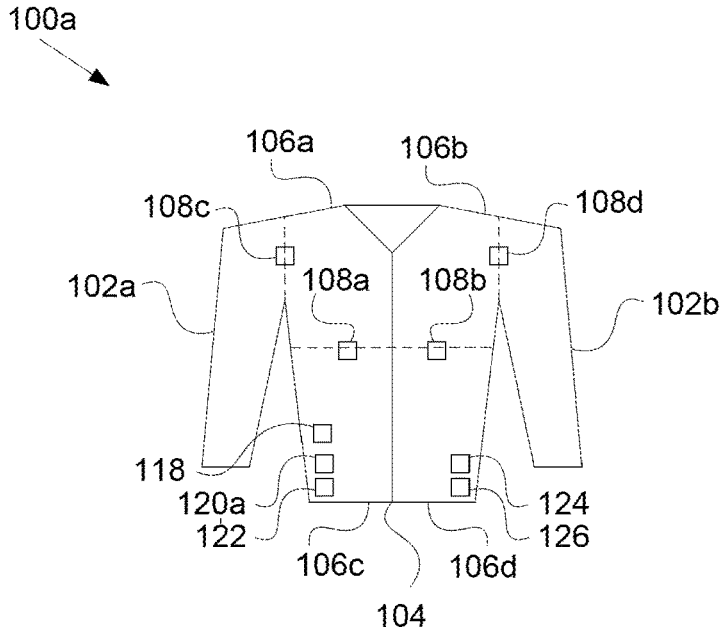
FIG. 4 is a front view of a wearable airbag jacket, according to one example.

FIG. 4 is a front view of a wearable airbag jacket 100*a*, according to one example. The wearable airbag jacket 100*a* includes a plurality of inflatable airbag chambers 106 (106*a*, 106*b*, 106*c*, 106*d*), a seam 104, a jacket sleeve 102*a*, a jacket sleeve 102*b*, a plurality of proportioning valves 108 (108*a*, 108*b*, 108*c*, 108*d*), an airbag igniter 120, a power source 122, a communication link 124, and a sensor array 126, the sensor array 126 comprising at least one of a gyroscope, an accelerometer, and a binary sensor for detecting usage of the wearable airbag jacket 100*a*. The plurality of airbag chambers 106 may have a plurality of proportioning valves 108 disposed between at least one pair of adjacent airbag chambers 106, permitting distribution of inflation pressure and air volume throughout the wearable airbag jacket 100*a* upon inflation, depending on needs and settings. In one example, multiple airbag igniters 120 may be provided instead of proportioning inflation among more than one airbag chamber 106 with a plurality of proportioning valves 108. In another example, proportioning may not be provided and inflation pressure of each airbag chamber 106 is nominally equal to that of the other airbag chambers 106.

The plurality of airbag chambers 106 may be disposed in a folded, uninflated condition on or within the wearable airbag jacket 100*a*, and may also be sewn or otherwise connected to the wearable airbag jacket 100*a* in a way that may allow only one-time use, similar to that for a vehicle airbag 202.

In one example, the plurality of the airbag chambers 106 may be uniformly distributed throughout the wearable airbag jacket 100*a*. In another example, the plurality of airbag chambers 106 may be more concentrated in certain locations of the wearable airbag jacket 100*a*, for example having more of the airbag chambers 106 disposed on a first side of the wearable airbag jacket 100*a* than on a second side of the wearable airbag jacket 100*a*.

A controller 118 is disposed inside or about the wearable airbag jacket 100*a*, controls the operation of the wearable airbag jacket 100*a*, and is connected to at least one airbag igniter 120, the power source 122, the communication link 124, and the sensor array 126. The airbag igniter 120, the power source 122, the communication link 124, and the sensor array 126 may also be disposed inside or about the wearable airbag jacket 100*a*.

The airbag igniter 120 is controlled by the controller 118. In a case the controller 118 receives a trigger signal and detects a need to deploy the plurality of airbag chambers 106, the airbag igniter 120 is triggered to inflate at least one of the plurality of airbag chambers 106. The airbag igniter 120 may comprise a solid-propellant to quickly burn and expand a volume of gas rapidly to inflate the plurality of airbag chambers 106. The airbag igniter 120 may be triggered in a variety of ways, for example mechanically, electronically, or chemically. The wearable airbag jacket 100*a* may have more than one airbag igniter 120 variously disposed to allow some or all of the plurality of airbag chambers 106 to be deployed.

The power source 122 provides the energy to operate the controller 118 and control the functions of the wearable airbag jacket 100*a*. The power source 122 includes an energy storage device 136, and may also include a way to charge the energy storage device 136. Power may be received through a wired or wireless connection to the power source 122, for example through a cable connected to a power source disposed within the vehicle 200, a contact charger that makes contact with a portion of the wearable airbag jacket 100*a* in a case where the occupant 150 is seated in a seat 140, or a wireless inductive charger. The power source 122 may detect use of the wearable airbag jacket 100*a* in a number of ways, for example through motion detection using an accelerometer of the sensor array 126, fastening of the seam 104, or through communication between the controller 118 and a vehicle Control Area Network (CAN) 204. In another example, the wearable airbag jacket 100*a* is powered by an energy storage device 136 that may not be rechargeable. The power source 122 may include an indication of when a change in energy storage device 136, for example a battery, is needed to maintain performance of the wearable airbag jacket 100*a*.

The communication link 124 allows communication between the controller 118 and the vehicle CAN 204, and may also be connected with other devices and networks. Exemplary functions include connecting with the vehicle CAN 204 for verifying a vehicle airbag 202 is active. The communication link 124 may communicate via a variety of links, for example Bluetooth, IEEE 802.11, and near-field communication (NFC) are non-limiting examples of wireless communication protocols that may be used for communication between the controller 118, the vehicle CAN 204, and other electronic devices such as a smart phone or tablet computer, to confirm that the vehicle airbag 202 is active and functioning normally. In one example, communication may be encrypted to help ensure security. In another example, the connection may use a handshake method of authentication to provide a level of secure communication between the controller 118 and the vehicle CAN 204. In another example, the connection may use more than one type of communication method to optimize both security and speed. In another example, the communication link 124 may also provide power to the controller 118, such as by a USB connection.

The sensor array 126 detects data related to operation of the wearable airbag jacket 100*a*, for example, gyroscopic and accelerometer information about the disposition and movement of the wearable airbag jacket 100*a*, and provides data to the controller 118 for analysis and processing.

The controller 118 controls each of the airbag chamber 106 and proportioning valves 108 to accommodate users of various size, adjust the proportioning of the plurality of proportioning valves 108 to accommodate the orientation of the user, and control the operation of the airbag igniter 120. For example, the controller 118 may adjust the proportioning of the plurality of proportioning valves 108 such that a greater portion of an inflation volume would be directed toward the first side of the wearable airbag jacket 100*a* than directed toward the second side of the wearable airbag jacket 100*a* if the controller 118 detects that the occupant 150 is disposed facing a direction of impact. In another example, the controller 118 may adjust the proportioning of the plurality of proportioning valves 108 such that a greater portion of an inflation volume would be directed toward the second side of the wearable airbag jacket 100*a* than directed toward the first side of the wearable airbag jacket 100*a* if the controller 118 detects that the occupant 150 is disposed facing opposite a direction of impact. In another example, the controller 118 may adjust the proportioning of the plurality of proportioning valves 108 such that the amount of the inflation volume of the first side of the wearable airbag jacket 100*a* would be reduced if the controller 118 detects the occupant 150 is of a smaller mass, and therefore requires less energy to be absorbed in a direction of impact by the wearable airbag jacket 100*a*.

The controller 118 may detect the volume or mass of the occupant 150 based on at least one of several factors including weight range of an occupant 150 detected through the seat 140, a weight range based on a size rating of the wearable airbag jacket 100*a* (e.g. small, medium, large), and any electronic configuration or connection established by the occupant 150 such as by occupant 150 input via an electronic device.

The controller 118 may further infer or authenticate information about the occupant 150 wearing the wearable airbag jacket 100*a* through biometric readings to confirm identity. The sensor array 126 may include sensors for blood pressure, pulse, and fingerprints (for identity authentication) that are made available to the controller 118.

The wearable airbag jacket 100*a* may deploy the plurality of airbag chambers 106 if the wearable airbag jacket 100*a* is worn by a vehicle occupant and a crash event is detected, via one or more trigger signals. Trigger signals may comprise certain performance criteria such as a vehicle airbag 202 is deployed, or the wearable airbag jacket 100*a* is accelerating at a rate above an acceleration threshold, or the controller 118 otherwise detects a need to deploy an airbag. The vehicle 200 may have one or more modes of operation that require that at least one wearable airbag jacket 100*a*, or at least one wearable airbag jacket 100*a* for each occupant 150 detected in the vehicle 200, before a particular mode of the vehicle 200 will engage. For example, the vehicle may be configured to require each occupant 150 detected to be wearing a wearable airbag jacket 100*a* before the vehicle 200 can be operated in an autonomous driving mode.

Each of the plurality of airbag chambers 106 is vented with a plurality of vent holes 128 to allow rapid inflation and then gradual deflation of the plurality of airbag chambers 106, allowing user mobility after deployment of airbags.

The controller 118 may check that there is sufficient power to operate the airbag igniter 120, establish communication with the vehicle CAN 204, verify use of the wearable airbag jacket 100*a*, and operate the sensor array 126. Further, the controller 118 may control proportioning of pressure distribution between the plurality of airbag chambers 106 by adjustment of the plurality of proportioning valves 108.

Figure 5:
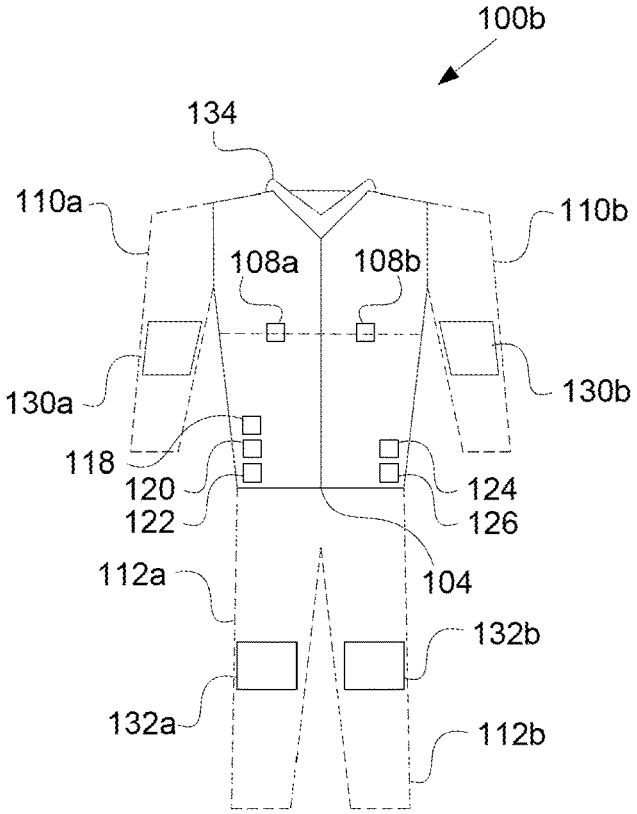
FIG. 5 is a front view of a wearable airbag vest wearable airbag vest connected to additional components, according to one example.

FIG. 5 is a front view of a wearable airbag vest wearable airbag vest 100*b* connected to additional components, according to one example. The wearable airbag vest 100*b* includes the plurality of inflatable airbag chambers 106 (106*a*, 106*b*, 106*c*, 106*d*), the seam 104, the plurality of proportioning valves 108 (108*a*, 108*b*, 108*c*, 108*d*), the controller 118, the airbag igniter 120, the power source 122, the communication link 124, the sensor array 126, an elbow airbag 130*a*, a elbow airbag 130*b*, a knee airbag 132*a*, a knee airbag 132*b*, and a neck airbag 134. The wearable airbag vest 100*b* is similar to the wearable airbag jacket 100*a* but without the jacket sleeve 102*a* and the jacket sleeve 102*b* of the wearable airbag jacket 100*a*. An arm 110*a* and an arm 110*b* are depicted by dashed lines to illustrate where the elbow airbag 130*a* and the elbow airbag 130*b* may be worn by the occupant 150. A 112*a* and a 112*b* are depicted via dashed lines to illustrate where the knee airbag 132*a* and the knee airbag 132*b* may be worn by the occupant 150.

The elbow airbag 130*a* and the elbow airbag 130*b* are supplemental airbags intended to cover and protect at least a portion of the arm 110*a* and a portion of the arm 110*b*, respectively. The knee airbag 132*a* and the knee airbag 132*b* are supplemental airbags intended to cover and protect at least some of the 112*a* and the 112*b*, respectively.

Each elbow airbag 130, each knee airbag 132, and the neck airbag 134 comprises at least one airbag chamber 106 and may connect to the controller 118 via a wireless and/or a wired connection, and may be controlled by the controller 118 in a manner similar to the plurality of airbag chambers 106 disposed within the wearable airbag vest 100*b*. The neck airbag 134 may be structurally connected to the wearable airbag vest 100*b* or a separate part, similar to the elbow airbag 130 and the knee airbag 132.

Figure 6A:
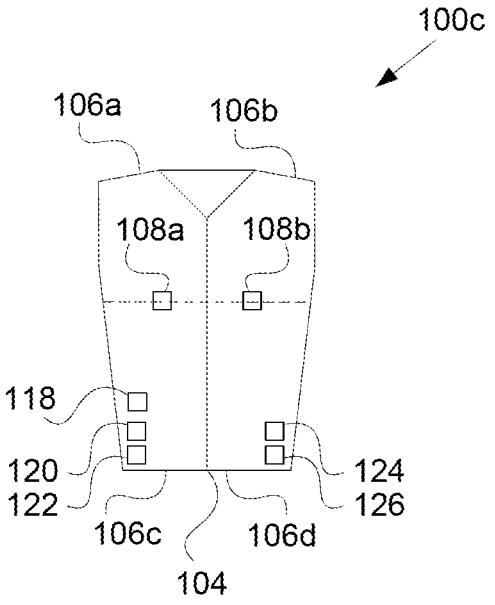
FIG. 6A is a front view of a wearable airbag vest, according to one example.

FIG. 6A is a front view of a wearable airbag vest 100*c*, according to one example. The wearable airbag vest 100*c* is similar to the wearable airbag vest 100*b* and operates in the same manner, but does not have the elbow airbag 130*a*, the elbow airbag 130*b*, the knee airbag 132*a*, the knee airbag 132*b*, and the neck airbag 134. The wearable airbag vest 100*c* includes the plurality of inflatable airbag chambers 106 (106*a*, 106*b*, 106*c*, 106*d*), the seam 104, the plurality of proportioning valves 108 (108*a*, 108*b*), the controller 118, the airbag igniter 120, the power source 122, the communication link 124, and the sensor array 126.

Figure 6B:
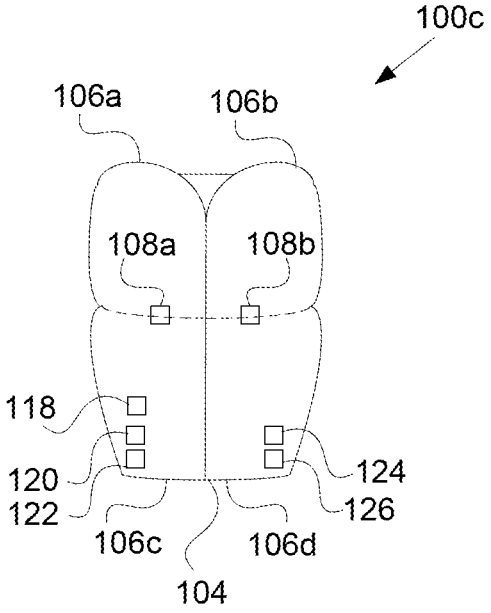
FIG. 6B is a front view of the wearable airbag vest in an inflated condition, according to one example.

FIG. 6B is a front view of the wearable airbag vest 100*c* in an inflated condition, according to one example. The wearable airbag vest 100*c* is identical to that described by FIG. 6A except that the wearable airbag vest 100*c* is in a fully inflated, post deployment state and has not yet deflated.

Figure 7:
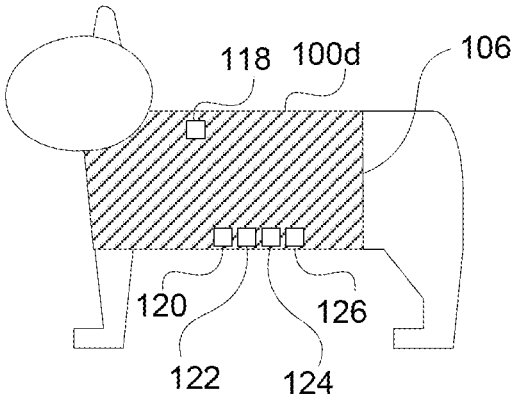
FIG. 7 is a side view of a pet connected to a wearable airbag wrap, according to one example.

FIG. 7 is a side view of a pet connected to a wearable airbag wrap 100*d*, according to one example. The 100*d* may have one or more airbag chambers 106 and be shaped to accommodate a pet 152, for example a dog or a cat, the controller 118, the airbag igniter 120, the power source 122, the communication link 124, and the sensor array 126. The pet 152 disposed inside a vehicle 200 is subject to some of the same accident risks as a human occupant 150 and may not be secured to the vehicle 200. Thus the pet 152 may benefit from having additional protection by being disposed within the wearable airbag wrap 100*d* while in transit within the vehicle 200. In one example, the vehicle 200 may not require engagement of the wearable airbag wrap 100*d* to operate in an autonomous driving mode. However, the use of the wearable airbag wrap 100*d* may be useful for the vehicle CAN 204 to detect the presence of the pet 152 on a seat 140 to confirm the seat 140 is not occupied by a human occupant 150. This allows flexibility with whether or not to potentially disable any vehicle airbag 202 intended for a seat 140 that, while showing the presence of a sufficiently heavy object, is known not to be occupied by an occupant 150. Further, less stringent or precise requirements with the wearable airbag wrap 100*d* than with the wearable airbag jacket 100*a*, the wearable airbag vest 100*b*, and the wearable airbag vest 100*c* allows the pet 152 to move about without affecting the operation of the vehicle airbag 202 while still affording the pet 152 some or all of the protections of the wearable airbag wrap 100*d*.

The wearable airbag wrap 100*d* operates in a similar manner to the wearable airbag jacket 100*a*, the wearable airbag vest 100*b*, and the wearable airbag vest 100*c*. The controller 118 is powered by the power source 122. In a case the controller 118 detects a need, such as through monitoring of the communication link 124 and the sensor array 126, the controller 118 signals the airbag igniter 120 to deploy and inflate the airbag chamber 106, providing a protective layer around the body of the pet 152.

Figure 8:
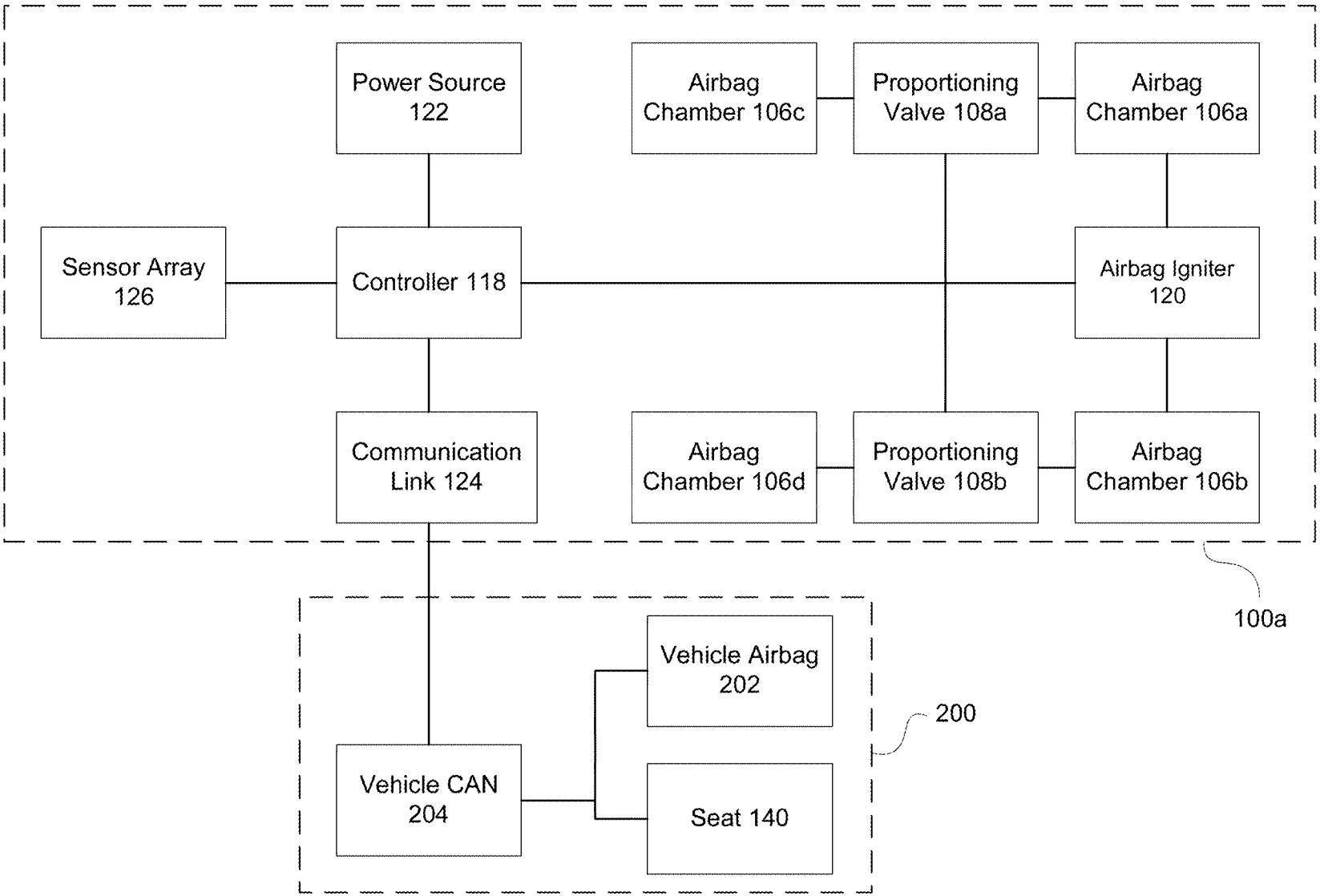
FIG. 8 is a block diagram of the circuitry of the wearable airbag jacket connected to a vehicle.

FIG. 8 is a block diagram of the circuitry of the wearable airbag jacket 100*a* connected to a vehicle 200. The wearable airbag jacket 100*a* is connected to the vehicle CAN 204 of the vehicle 200 by the communication link 124. The controller 118 is connected to the communication link 124, the sensor array 126, the power source 122, and the airbag igniter 120. The airbag igniter 120 is connected to the airbag chamber 106*a* and the airbag chamber 106*b*. The airbag chamber 106*a* is connected to the proportioning valve 108*a*, the airbag chamber 106*b* is connected to the proportioning valve 108*b*, and the proportioning valve 108*a* and the proportioning valve 108*b* are connected to the airbag chamber 106*c* and the airbag chamber 106*d*, respectively.

As described by FIG. 4, the controller 118 may be powered by the power source 122, detect usage of the wearable airbag jacket 100*a* through data received from the sensor array 126, communicate with the vehicle CAN 204 via the communication link 124, and inflate the plurality of airbag chambers 106 (106*a*, 106*b*, 106*c*, and 106*d*) as needed by activating the airbag igniter 120. The vehicle CAN 204 is connected to the vehicle airbag 202 and the seat 140.

Figure 9:
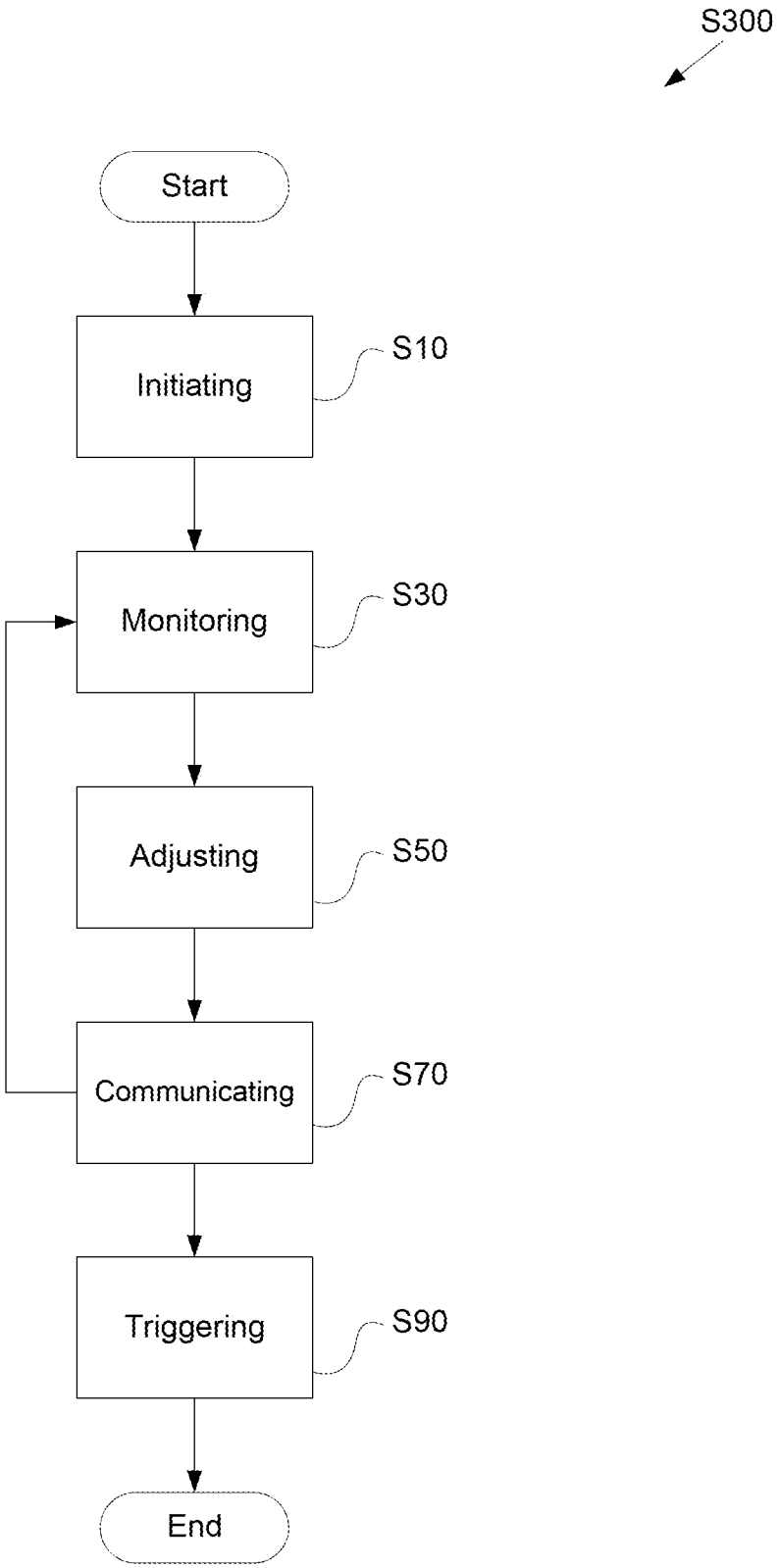
FIG. 9 is a process diagram for the wearable airbag jacket, according to one example.

FIG. 9 is a process diagram for the wearable airbag jacket 100*a*, according to one example. The process diagram includes a sequence of primary processes of an airbag deployment method S300 for the wearable airbag jacket 100*a*. The diagram encompasses various operations of the system examples and embodiments described by FIG. 4 through FIG. 6B. The airbag deployment method S300 includes, in this example, an initiating process S10, a monitoring process S30, an adjusting process S50, a communicating process S70, and a triggering process S90. Some or all aspects of the process S300 may also be applicable to the wearable airbag vests 100*b*, 100*c*, and the wearable airbag wrap 100*d*.

S10 represents a process of initiating use of the wearable airbag jacket 100*a*, which may include, without limitation, steps related to the controller 118 confirming available energy in the power source 122, detecting a weight of the occupant 150 in the seat 140 of the vehicle 200, and checking that the communication link 124 is operational and able to communicate with the vehicle CAN 204. If any aspects checked by the controller 118 are not sufficient, notification may be provided to the occupant 150 through at least one of the vehicle 200, the wearable airbag jacket 100*a*, and another electronic device, for example a smart phone or tablet. Further, the vehicle CAN 204 may be configured such that each occupant 150 known to occupy a seat 140 must be wearing a properly functioning and configured wearable airbag jacket 100*a* such that the wearable airbag jacket 100*a* may have to be in operation before an autonomous or semi-autonomous driving mode of the vehicle 200 may be activated. Such requirement may not apply to the pet 152 wearing the wearable airbag wrap 100*d*.

S30 represents a process of the controller 118 monitoring data from the sensor array 126 and the communication link 124. This may include steps, where applicable and without limitation, related to monitoring the vehicle 200 for a change in velocity of the vehicle 200, deployment of a vehicle airbag 202, or other signal on the vehicle CAN 204 indicating an emergency incident, as well as detecting the presence of the occupant 150, whether the occupant 150 is secured by a restraint device such as a seatbelt, and detecting a weight or weight range of the occupant 150, such as through the seat 140 connected to the vehicle CAN 204. Further, data detected by the sensor array 126 may allow the controller 118 to determine a relative position and motion of the occupant 150 with respect to the vehicle 200, such as the seating location and position of the occupant 150, which way the occupant 150 is facing, how far the occupant 150 is reclined, if there is motion of the wearable airbag jacket 100*a*, and the rate and direction of such motion.

S50 represents an optional process of adjusting settings of each proportioning valve 108 within the wearable airbag jacket 100*a* to better accommodate different sized occupant 150, and occupant 150 in different positions. Each proportioning valve 108 that links two airbag chambers 106 together may have its proportion settings adjusted to alter the balance of air volume routed between any two airbag chambers 106 in the event of a crash, allowing certain airbag chambers 106 to be inflated to a greater volume than others. This is intended to provide the occupant 150 with protection based on the direction or anticipated direction of impact. The level of inflation of the plurality of airbag chambers 106 may also be adjusted to accommodate for smaller occupant 150, for example a fifth percentile female, by reducing the triggering force supplied by the airbag igniter 120 as appropriate.

In one example, the occupant 150 is seated in a forward facing position within the vehicle 200, and the occupant 150 is wearing the wearable airbag jacket 100*a*. A first side of the wearable airbag jacket 100*a* is facing forward. The controller 118 may adjust the plurality of proportioning valves 108 within the wearable airbag jacket 100*a* to direct more air volume toward the plurality of airbag chambers 106 disposed on the first side (e.g. the front) of the wearable airbag jacket 100*a* in the event the airbag igniter 120 is triggered.

In another example, the occupant 150 is seated in a rearward facing position within the vehicle 200, and the occupant 150 is wearing the wearable airbag jacket 100*a*. A second side (e.g. the back) of the wearable airbag jacket 100*a* is facing forward. The controller 118 may adjust the plurality of proportioning valves 108 within the wearable airbag jacket 100*a* to direct more air volume toward the plurality of airbag chambers 106 disposed on the second side of the wearable airbag jacket 100*a* in the event the airbag igniter 120 is triggered.

In another example, the occupant 150 is seated in a side facing position within the vehicle 200, and the occupant 150 is wearing the wearable airbag jacket 100*a*. The first side (e.g. the front) of the wearable airbag jacket 100*a* is facing a side of the vehicle 200. The controller 118 may adjust the plurality of proportioning valves 108 within the wearable airbag jacket 100*a* to direct more air volume toward the plurality of airbag chambers 106 disposed toward a third side of the wearable airbag jacket 100*a* closest to the front of the vehicle 200 in the event the airbag igniter 120 is triggered.

S70 represents a process of the controller 118 communicating data or a status of use from the controller 118 to the vehicle CAN 204 through the communication link 124. Status and data may include those from the processes S10 and S30, for example those related to available energy in the power source 122, presence and weight of the occupant 150, a velocity change of the vehicle 200, deployment of a vehicle airbag 202, other signals on the vehicle CAN 204 indicating an emergency incident, as well as whether the occupant 150 is secured by a restraint device such as a seatbelt, and data detected by the sensor array 126 that may allow the controller 118 to determine a relative position and motion of the occupant 150 with respect to the vehicle 200, such as the seating location and position of the occupant 150, which way the occupant 150 is facing, how far the occupant 150 is reclined, if there is motion of the wearable airbag jacket 100*a*, and the rate and direction of such motion.

These steps may include using information external to the controller 118 to better optimize usage of the wearable airbag jacket 100*a*. This information can be received wirelessly by the controller 118 through a vehicle network as would be understood by one of ordinary skill in the art.

S90 represents a process of triggering one or more airbag igniters 120 to inflate a plurality of airbag chambers 106. The controller 118 detects a requirement to deploy the wearable airbag jacket 100*a*. Thus it signals the airbag igniter 120 to activate, resulting in the inflation of at least one of a plurality of airbag chambers 106 within the wearable airbag jacket 100*a*, and communicates the deployment of the wearable airbag jacket 100*a* to the vehicle CAN 204.

In one example, the wearable airbag jacket 100*a* comprises one airbag igniter 120 and the airbag igniter 120 activates and deploys the plurality of airbag chambers 106.

In another example, the wearable airbag jacket 100*a* comprises more than one airbag igniter 120 and at least one airbag igniter 120 activates at least one airbag chamber 106.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernable variants of the teachings herein, define, in part, the scope of the foregoing claim terminology such that no inventive subject matter is dedicated to the public.

What is claimed is:

1. A system for providing wearable inflatable impact protection, the system comprising:

a wearable airbag garment;

a first airbag chamber connected to the wearable airbag garment;

a second airbag chamber;

an airbag igniter connected to the first airbag chamber;

a controller connected to the airbag igniter;

communication link circuitry configured to link the controller and a vehicle control area network (CAN);

at least one proportioning valve disposed between the first airbag chamber and the second airbag chamber, the at least one proportioning valve controlled by the controller; and a sensor array connected to the controller;

wherein the sensor array detects at least one of use, movement, location, and acceleration of the wearable airbag garment, the controller triggers the airbag igniter to inflate the first airbag chamber in a case where the controller determines at least one of a set of performance criteria has been exceeded, and the controller, in response to crash data received from the vehicle CAN, adjusts the proportion of a gas pressure directed to the second airbag chamber via the at least one proportioning valve as the airbag igniter inflates the first airbag chamber.

2. The system for providing wearable inflatable impact protection according to claim 1, wherein, the set of performance criteria includes at least one of a case in which the controller detects acceleration of the wearable airbag garment is above a threshold acceleration, and a case wherein the controller receives a trigger signal from the vehicle CAN.

3. The system for providing wearable inflatable impact protection according to claim 1, wherein the controller is configured to only allow a vehicle to operate in a driving mode having some level of autonomy in a case where the wearable airbag garment is in use by a human occupant.

4. The system for providing wearable inflatable impact protection according to claim 1, further comprising:

a power source, wherein the power source comprises a battery.

5. The system for providing wearable inflatable impact protection according to claim 1, wherein the wearable airbag garment is a jacket having sleeves.

6. The system for providing wearable inflatable impact protection according to claim 1, wherein the wearable airbag garment is a sleeveless vest.

7. The system for providing wearable inflatable impact protection according to claim 1, further comprising:

a neck airbag connected to the wearable airbag garment, the neck airbag having at least one airbag chamber disposed within.

8. The system for providing wearable inflatable impact protection according to claim 1, further comprising:

at least one elbow airbag connected to the wearable airbag garment, the at least one elbow airbag having at least one airbag chamber disposed within.

9. The system for providing wearable inflatable impact protection according to claim 1, further comprising:

at least one knee airbag connected to the wearable airbag garment, the at least one knee airbag having at least one airbag chamber disposed within.

10. The system for providing wearable inflatable impact protection according to claim 1, wherein each airbag chamber comprises a plurality of vent holes.

11. The system for providing wearable inflatable impact protection according to claim 1, wherein the wearable airbag garment operates independently of a driving mode of the vehicle, and the wearable airbag garment is a wrap for a pet.

12. A system for providing wearable inflatable impact protection, the system comprising:

a wearable airbag garment;

a first airbag chamber connected to the wearable airbag garment;

a second airbag chamber;

an airbag igniter connected to the first airbag chamber;

control means for controlling the airbag igniter;

communication means linking the control means and a vehicle control area network (CAN);

at least one proportioning valve disposed between the first airbag chamber and the second airbag chamber, the at least one proportioning valve controlled by the control means; and a sensor array connected to the control means;

wherein the sensor array detects at least one of use, movement, location, and acceleration of the wearable airbag garment, the control means triggers the airbag igniter to inflate the first airbag chamber in a case where the control means determines at least one of a set of performance criteria has been exceeded, and the control means, in response to crash data received from the vehicle CAN, adjusts the proportion of a gas pressure directed to the second airbag chamber via the at least one proportioning valve as the airbag igniter inflates the first airbag chamber.

* * * * *